United States Patent [19]

Miyazaki

[11] Patent Number: 4,606,214

[45] Date of Patent: Aug. 19, 1986

[54] METAL FORMING APPARATUS

[75] Inventor: Takeshi Miyazaki, Inazawa, Japan

[73] Assignee: Toyoda Gosei Co., Ltd., Nishikasugai, Japan

[21] Appl. No.: 677,098

[22] Filed: Nov. 30, 1984

[30] Foreign Application Priority Data

Nov. 30, 1983 [JP] Japan ..... 58-226480

[51] Int. Cl.[4] ..... B21D 41/02

[52] U.S. Cl. ..... 72/318; 72/313; 72/370

[58] Field of Search ..... 72/318, 316, 315, 313, 72/370, 357

[56] References Cited

U.S. PATENT DOCUMENTS

| | | | |
|---|---|---|---|
| 365,212 | 6/1887 | Wilder | 72/318 |
| 1,750,290 | 3/1930 | Valentine et al. | 72/370 |
| 2,424,871 | 7/1947 | Wenk et al. | 72/313 |
| 3,381,515 | 5/1968 | Orloff | 72/357 |
| 3,820,375 | 6/1974 | Koski | 72/318 |
| 3,965,716 | 6/1976 | Suzuki et al. | 72/357 |

FOREIGN PATENT DOCUMENTS

| | | | |
|---|---|---|---|
| 2051042 | 4/1972 | Fed. Rep. of Germany | 72/357 |
| 3216287 | 11/1983 | Fed. Rep. of Germany | 72/318 |
| 892543 | 3/1962 | United Kingdom | 72/318 |
| 774752 | 10/1980 | U.S.S.R. | 72/357 |

*Primary Examiner*—Daniel C. Crane

*Attorney, Agent, or Firm*—Cushman, Darby & Cushman

[57] ABSTRACT

The present invention concerns an apparatus for forming into shape one end portion of a rod-like metallic work such as a pipe. The apparatus comprising a holding member to hold the work, a split die composed of at least two movable die members, and a pressure die. Both the split die and the pressure die have engaging portions which move the split die in directions perpendicular to the axial direction with movement of the pressure die in the axial direction. The split die clamps the outer surface of the end portion of the work. Further the pressure die moves toward the holding member and forms the end portion of the work into shape between the split die and the pressure die. So, as set forth hereinabove, both clamping for the split die and forming for the work can be done by the one stroke of the pressure die. Thus, it is not necessary to provide two drive sources for moving the split die and for moving the pressure die, and therefore it is possible to attain simplification of equipment.

4 Claims, 6 Drawing Figures

METAL FORMING APPARATUS

BACKGROUND OF THE INVENTION

1. Field of the Invention

The present invention relates to an apparatus for forming into shape an end portion of a rod-like metallic work such as a pipe.

2. Description of the Prior Art

Conventional apparatus for forming into shape an end portion of a rod-like metallic work such as a pipe are of a construction in which the rod-like metallic work is held by a holding member and in this state movable members which constitute a split die are moved in a direction perpendicular to the axial direction of the rod-like work to clamp the work, thereby gripping and covering the outer peripheral surface of the work with the split die, then a pressure die is moved in the axial direction of the work thereby forming into shape the fore end portion of the rod-like metallic work.

In such conventional apparatus, therefore, it has been necessary to provide both a drive source for moving in said perpendicular direction the movable members which constitute the split die and a drive source for moving the pressure die in said axial direction. Consequently, the equipment has been complicated.

SUMMARY OF THE INVENTION

The present invention has been accomplished in view of the above prior art.

The primary object of the present invention is to provide a metal forming apparatus in which both clamping for a split die and forming for a rod-like metallic work with a pressure die can be done by the use of single drive source for moving the pressure die in the axial direction of the rod-like metallic work.

In the present invention, as set forth hereinabove, both clamping for the split die and forming for a rod-like metallic work by the pressure die can be done by the use of a unidirectional drive source alone which is for moving the pressure die in the axial direction of the rod-like metallic work. Thus, it is not necessary to provide a drive source for moving the split die, and therefore it is possible to attain simplification of equipment in comparison with the conventional construction.

DETAILED DESCRIPTION OF THE INVENTION

Figure 3:
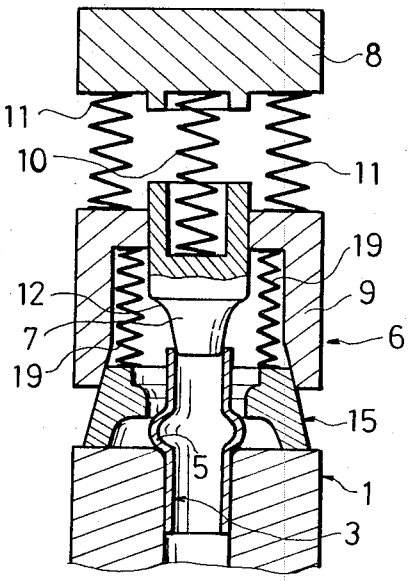
FIGS. 1 to 5 are longitudinally sectional views of a metal forming apparatus according to an embodiment of the present invention, successively showing steps of pipe flaring operations.

The metal forming apparatus of the present invention comprises a holding member for holding a rod-like metallic work, a split die comprising at least two movable die members for gripping and covering the outer peripheral surface of the work, a holder for the split die, and a pressure die adapted to be moved from one end of the work along the axial direction of the work to form into shape the end portion of the work in cooperation with the split die. The split die has a first engaging portion and the holder has a second engaging portion which engages said first engaging portion. The first and second engaging portions move the split die in directions perpendicular to the axial direction with movement of the pressure die in the axial direction so as to clamp the split die. Then, by the further movement of the pressure die the rod-like metallic work is plastically formed into shape between the split die and the pressure die.

The holding member suffices if only it has the function of holding a rod-like metallic work so that an end portion of the work to be formed into shape may be exposed. Therefore, the holding member may be formed with a hole to insert therein and thereby hold the work. Alternatively, it may be so constructed as to hold a rod-like metallic work by gripping. A typical example of a rod-like metallic work is a metallic pipe.

The split die, which is usually cylindrical in the assembled or clamped state, is disposed so that it can surround a rod-like metallic work held in place. It is composed of plural movable die members disposed in the circumferential direction of the split die. It is desirable that the split die be a bisectional type. But, it may be even quaternary. Further, the number of divisions may be even larger. The movable die members which constitute the split die are movable in directions perpendicular to the axial direction of the rod-like metallic material held in place. With such movement of the movable die members, the outer peripheral surface of the work can be gripped and covered with the movable die members. A spring member such as a coil spring or an elastic rubber may be held between the movable die members for pushing each of said members in their circumferential direction.

The pressure die is movable along the axial direction of the rod-like metallic work, whereby an end portion of the rod-like metallic work can be formed into shape in cooperation with the split die. To this end, the pressure die is usually disposed in a position coaxial with the rod-like metallic work held in place. The shape of the pressure die differs according to the kind of forming to be applied to the work. For example, in the case of flaring the fore end portion of a pipe as the work, there is used a divergent flaring pressure die. In the case of swaging the fore end portion of a pipe, there is used a swaging pressure die. The pressure die may be composed of a pressure die body for directly forming into shape one end portion of the work and a cylindrical holder provided therearound.

The split die has a first engaging portion and the holder has a second engaging portion. The both engaging portions are for permitting the movable die members to move in directions perpendicular to the above axial direction to thereby clamp the split die. Typically such engaging portions have tapered surfaces. For example, where the pressure die is of a construction including a pressure die body and a holder provided therearound forming the second engaging portion, a tapered surface is formed on the inner surface side of the holder, while also the outer peripheral portion of the split die forming the first engaging member has a tapered surface on the outer peripheral portion, and the tapered surface of the holder is brought into engagement with the tapered surface of the split die with movement of the pressure die in the above axial direction, whereby the split die is moved in directions perpendicular to the axial direction of the work and thereby clamped. The angle of inclination of the tapered surface is set appropriately. Preferably, it is in the range of about 10 to 30 degrees. In some particular working conditions, convex spherical surfaces may be used instead of the tapered surfaces. For example, a concave spherical surface as the surface of the engaging portion may be formed on the inner surface side of the holder, while a convex spherical surface as the engaging portion may be formed on the outer surface side side of the split die.

In forming into shape a rod-like metallic work by using the metal forming apparatus of the present invention, first the work is held in place by the holding member and in this state the pressure die is moved in the axial direction of the work. With this movement of the pressure die, the engaging portion of the holder comes into engagement with the engaging portion of the split die. With further movement of the pressure die in the above axial direction, the movable die members are moved in directions perpendicular to said axial direction by the thus-engaged engaging portions, whereby the split die is clamped. In this clamped state of the split die, the outer surface of the work held is gripped and covered with the split die.

With further movement of the pressure die in the same direction, namely, in the above axial direction in the thus-gripped state of the work by the split die, the fore end portion of the work is pressed by the moving pressure die, whereby the rod-like metallic work is formed into shape between the split die and the pressure die.

EMBODIMENT

FIGS. 1 to 5 illustrate a metal forming apparatus according to an embodiment of the present invention in which an end portion of a pipe as the rod-like metallic work is subjected to flaring.

The present invention will be described more concretely hereinunder in accordance with this embodiment.

A holding member 1 has a vertically extending bore 2. The inside diameter of the bore 2 is about the same or somewhat larger than the outside diameter of a pipe 3 as the rod-like metallic work. An upper end opening of the bore 2 is formed with a tapered guide portion 4 for guiding the pipe 3. The pipe 3 has a bulged portion 5 formed throughout its circumference by bulging.

A pressure die 6 includes a flaring pressure die body 7 coaxial with the bore 2, a movable die 8 disposed above and coaxially with the pressure die body 7, a cylindrical holder 9 disposed so as to surround the pressure die body 7, a coil spring 10 disposed between the upper surface portion of the pressure die body 7 and the lower surface portion of the movable die 8, and coil springs 11 disposed between the upper surface portion of the holder 9 and the lower surface portion of the movable die 8. The flaring pressure die body 7 is formed with an expanding portion 12 for flaring, and a circular projection 13 is formed on the upper surface portion of the pressure die body 7. Further, the movable die 8 is formed with a circular projection 14 in opposed relation to the projection 13.

A split die 15 is composed of two movable die members 16. The split die 15 is cylindrical in a clamped state thereof. The inner surfaces of the movable die members 16 are formed with inner projections 17 which are opposed to each other. The upper surfaces of the projections 17 serve as forming portions 18 for flaring the pipe 3. Each of the movable die members 16 of the split die 15 is slidably held on the die body 7 as shown.

Coil springs 19 are disposed between the upper surface portions of the movable die members 16 which constitute the split die 15 and the lower surface portion of a top wall of the holder 9. The coil spring 10 is made easier to undergo an elastic contraction than the coil springs 11 and 19, and the coil springs 19 are made easier to undergo an elastic contraction than the coil springs 11. Therefore, when the same force is exerted on the coil springs 11 and 19, the coil springs 19 will exhibit a larger amount of elastic contraction.

Tapered surfaces 20 as the first engaging portion are formed on the outer surface sides of the movable die members 16 which constitute the split die 15. The tapered surfaces 20 are downwardly divergent as shown. Also on the inner surface side of the holder 9 which constitutes a part of the pressure die 6 is formed a tapered surface 21 as a second engaging portion, which is inclined in the same direction as the tapered surfaces 20 as shown. The movable die members 16 are slidably held on the tapered surface 21 of the holder 9.

Using the metal forming apparatus of this embodiment, the pipe 3 is flared in the following manner.

Figure 2:
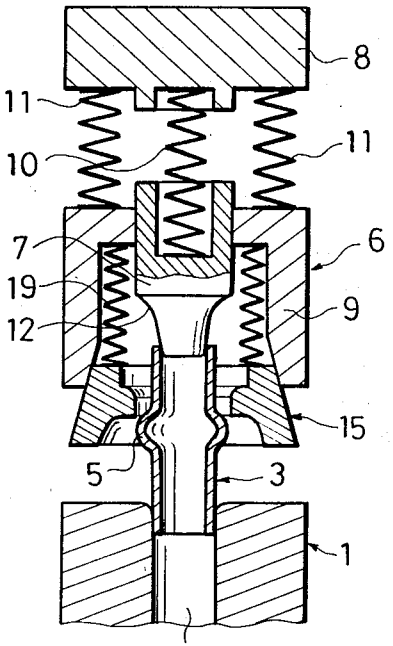
Figure 1:
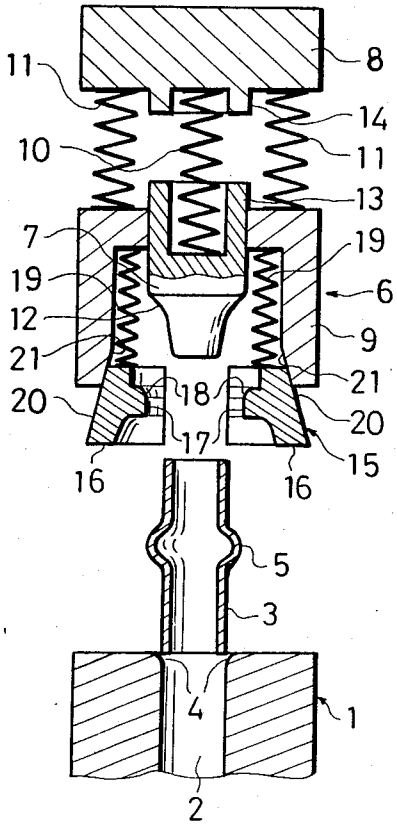

First, as shown in FIG. 1, the pipe 3 is set upright by using a suitable member in a position facing the bore 2 of the holding member 1. Then, the entirety of the pressure die 6 is moved downward together with the split die 15. As a result, as shown in FIG. 2 the fore end of the pressure die body 7 abuts the upper end opening of the pipe 3, whereby the lower portion of the pipe 3 is gradually fitted into the bore 2 until the bulged portion 5 of the pipe 3 abuts tapered guide portion 4 of the holding member 1 as shown in FIG. 3, whereupon the insertion of the pipe 3 is stopped and the pipe 3 is thereby held by the holding member 1. In this state, as shown in FIG. 3, the downward movement of the split die 15 also stops upon abutment of the lower surface portion of the split die 15 with the upper surface portion of the holding member 1.

Figure 4:
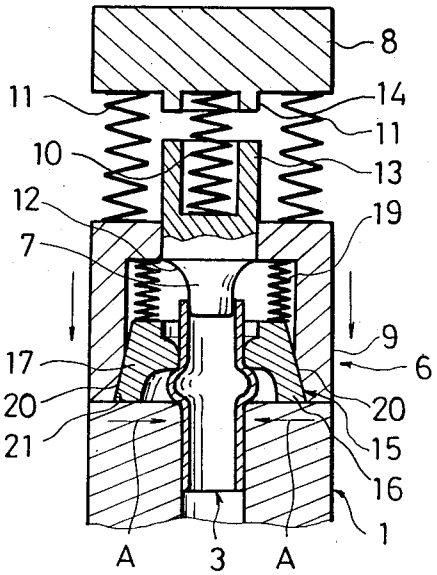

Further the pressure die 6 is moved downward in this state of abutment of the lower surface portion of the split die 15 with the upper surface portion of the holding member 1, the holder 9 as a rigid body descends straight and the coil springs 19 contract elastically as shown in FIG. 4 because the coil springs 19 are easier to contract than the coil springs 11 as previously noted. As a result, the tapered surfaces 20 and 21 engage each other and so the movable dies 16 are moved in the directions of arrows A, namely, in directions perpendicular to the axial direction of the pipe 3, within the holder 9 as a rigid body as shown in FIG. 4, whereby the split die 15 is clamped. In the thus-clamped state, as shown in FIG. 4, the projections 17 of the movable die members 16 grip and cover the outer peripheral surface of the pipe 3, and the bulged portion 5 of the pipe 3 is positioned in the space below the projections 17.

Figure 5:
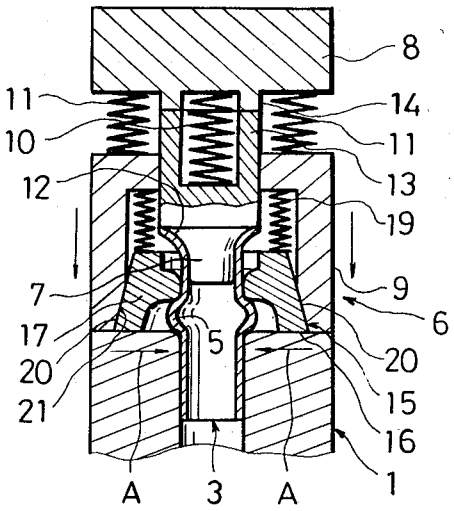

Further, with downward movement of the movable die 8, the projection 14 comes into contact with the projection 13 as shown in FIG. 5, so that the urging force of the movable die 8 is transmitted directly to the pressure die body 7 and so the fore end portion of the pressure die body 7 enters the interior of the pipe 3 to a further extent as shown in FIG. 5. As a result, the upper end portion of the pipe 3 is expanded by the expanding portion 12 of the pressure die body 7, whereby flaring of the pipe 3 is performed.

After completion of flaring of the pipe 3 as described above, the whole of the pressure die 6 is moved upward to its original position. As a result, the tapered portions 20 of the movable die members 16 move downward relative to the holder 9 and along the tapered portion 21 of the holder 9 by virtue of the biasing force of the coil spring 19, thereby allowing the movable die members 15 to move in directions opposite to the arrow A directions to open the split die 15.

In this embodiment, as described above, by a mere movement of the pressure die 6 in the axial direction of the pipe 3, both clamping for the split die 15 and flaring for the pipe 3 by the pressure die 6 can be done.

Although the coil springs 10, 11 and 19 capable of being easily elastically contracted and restored to the original state are used in the above embodiment illustrated in FIGS. 1 to 5, a contractible member made of foamed urethane rubber capable of being elastically contracted and restored to the original state may be used be in place of such coil springs. In some particular working conditions, moreover, a bellows with air sealed therein may be used and contracted as necessary in place of the coil springs 10, 11 and 19.

Figure 6:
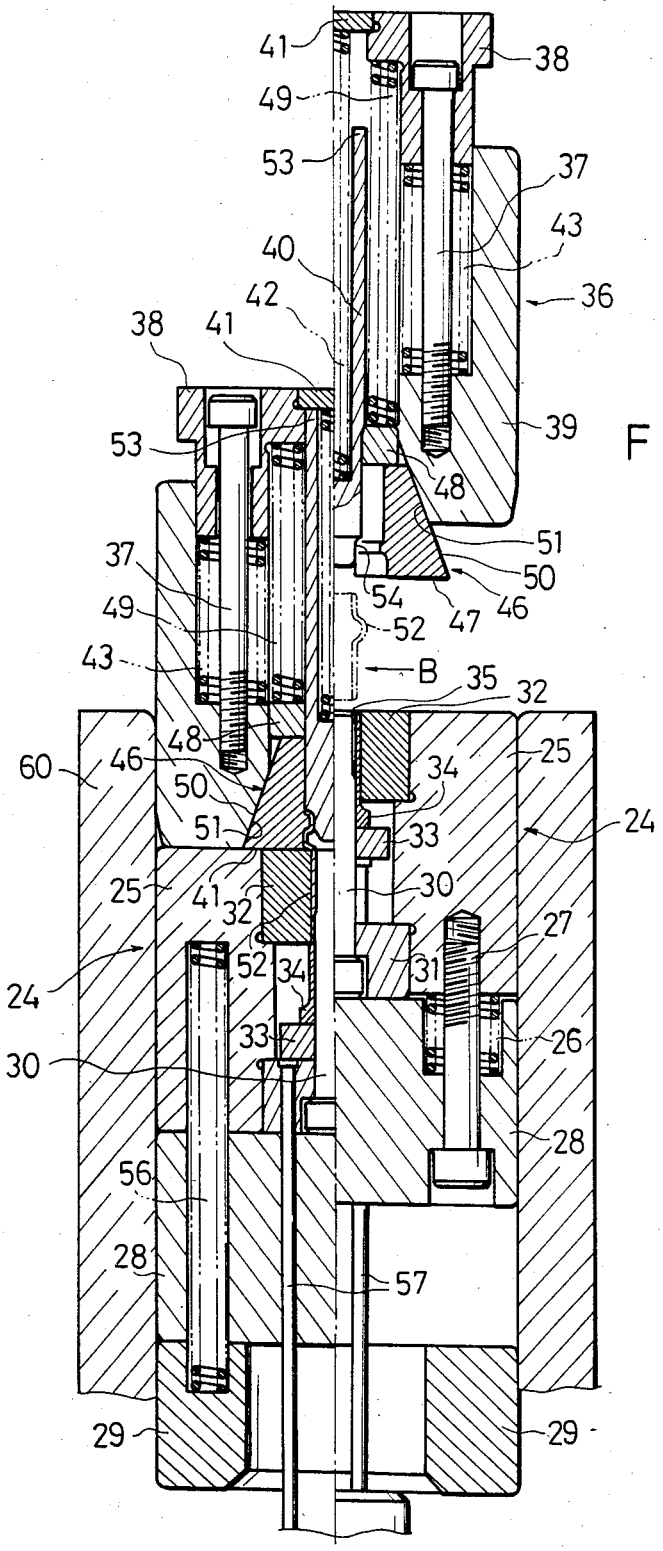
FIG. 6 is a longitudinally sectional side view of a metal forming apparatus according to another embodiment of the present invention, showing in a divided form both states before flaring and that after flaring.

Referring now to FIG. 6, there is illustrated another embodiment of the present invention, which is divided into halves (A) and (B) with respect to the central alternate long and short dash line, the half (A) being a sectional view showing a state before forming and the half (B) being a sectional view showing a state where the forming is completed. A holding member 24 includes a die holder 25, a plate 28 attached to the lower surface portion of the die holder 25 with a mounting bolt 27 with a coil spring 26 fitted thereon, and a lower plate 29 disposed below therebelow. A longitudinally extending lower punch 30 is mounted to the die holder 25 by means of a punch holder 31. Between the lower punch 30 and a die insert 32 is disposed a pipe releasing knock-out sleeve 34 through a spacer 33. The space between the lower punch 30 and the die insert 32 comprises a ring shaped bore 35.

A pressure die 36 includes a plate 38, a holder 39 which supports the plate 38 through a mounting bolt 37, a pressure die body 40 slidably inserted in the holder 39, a spacer 41 fixed to the plate 38, a coil spring 42 disposed between the spacer 41 and the pressure die body 40, and a coil spring 43 disposed between the lower surface portion of the plate 38 and the holder 39.

A split die 46 is mounted on the pressure die 36. Between each movable die member 47 as a constituent member of the split die 46 and the plate 38 is disposed a coil spring 49 through a spacer 48. The coil spring 42 is made easier to elastically contract than the coil springs 43 and 49, and the coil spring 49 is made easier to undergo an elastic contraction than the coil spring 43.

On the outer surface of each of the movable die members 47 as the constituent members of the split die 46 is formed a tapered portion 50 as an engaging portion so as to be downwardly divergent, while in opposed relation thereto a downwardly divergent tapered portion 51 as an engaging portion is formed on the inner surface of the holder 39 as a constituent member of the pressure die 36. The movable die members 47 are slidably held on the tapered portion 51 of the holder 39.

In flaring a pipe 52, the pipe 52 is set so as to face the bore 35 of the holding member 24 as shown in alternate long and short dash line in FIG. 6, and in this state the entirety of the pressure die 36 is moved downward. As a result, like the previous embodiment, the pipe 52 is pushed and moved downward by the fore end of the pressure die body 40, whereby the lower portion of the pipe 52 is fitted in the bore 35 between the lower punch 30 and the die insert 32, whereupon the coil spring 42 contracts elastically and absorbs the downward moving distance of the plate 38 and that of the spacer 31. In this case, with the downward movement of the pressure die 36, like the previous embodiment, the lower surface portion of the movable die member 47 as a constituent member of the split die 36 abuts the upper surface portions of the die holder 25 and die insert 32. Thereafter, the tapered portion 50 of the movable die member 47 moves along the tapered portion 51 on the pressure die 36 side, whereby the coil spring 49 contracts elastically. As a result, the movable die member 47 moves in the direction of arrow B, namely, in a direction perpendicular to the axial direction of the pipe 52 to thereby clamp the split die 46.

As the plate 38 as a constituent member of the pressure die 36 further moves downward, the spacer 41 comes into abutment with an upper end portion 53 of the pressure die body 40 due to elastic contractions of the coil springs 43, 49 and 42. In this abutted state, the urging force of the spacer 41 fixed to the plate 38 is transmitted directly to the upper end portion 53 of the pressure die body 40, so that the upper end portion of the pipe 52 is expanded by an expanding portion 54 formed near the fore end of the pressure die body 40, and thus the pipe 52 now set in the bore 35 is flared.

In this embodiment, as shown in FIG. 6, the whole of the holding member 24 is pushed and moved downward with downward movement of the pressure die 36, whereby the lower surface portion of the plate 28 is brought into abutment with the upper surface portion of the lower plate 29. This is for inner-chamfering of the lower end of the pipe 52 by a stepped potion formed at the central part of the lower punch 30 and also for inserting the lower portion of the pressure die 36 into a cylindrical holder 60 disposed around the holding member 24 and thereby making alignment between the holding member 24 and the pressure die 36. When the pressure die 36 returns to its original position, the plate 28 is restored to its original state by virtue of the biasing force of a coil spring 56.

After flaring the pipe 52 as described above, the whole of the pressure die 36 is moved upward and returned to its original position, and in this state, by operating a knock-out pin 57 upward, the pipe 52 is pushed upward through the spacer 33 and knock-out sleeve 34, thereby permitting the pipe 52 to be removed from the holding member 24.

Also in this embodiment, as set forth above, both clamping for the split die 46 and flaring for the pipe 52 by the pressure die 36 can be done by only a downward movement of the pressure die 36. Therefore, the power source may be a single cylinder for moving the pressure die 36 downward.

What is claimed is:

1. Apparatus for forming one end portion of a rod-like metallic work comprising:

a holding member for holding the work along its axis;

a pressure die movably mounted along said axis towards and away from said holding members and adapted for relative movement with respect to one end of the work along the axis thereof to shape the axial end portion of the work, said pressure die comprising:

a die body engageable with the end portion of the work;

a split die comprising at least two movable die members for gripping and covering the outer peripheral surface of the work; and a holder for the split die movable axially relative thereto and therewith, said die body being mounted within said holder and said split die being carried by said holder, said split die having a first engaging portion and said holder having a second engaging portion which engages said first engaging portion to move said split die members in directions perpendicular to the axis of the work on said relative movement of said pressure die axially toward said holding member and toward the work so that said split die is clamped to and covers the peripheral surface of the end portion of the work and then the end portion is plastically formed into shape by said die body when held by said split die.

2. An apparatus as set forth in claim 1, wherein said pressure die is a flaring pressure die.

3. An apparatus as set forth in claim 1, wherein both of said first and second engaging portions have tapered surfaces.

4. An apparatus as set forth in claim 1, wherein a spring member is provided between the holder and the split die to force the first and second engaging portions apart from each other.

* * * * *